US008038238B2

(12) United States Patent
Sakurai

(10) Patent No.: US 8,038,238 B2
(45) Date of Patent: Oct. 18, 2011

(54) PRINTHEAD SUBSTRATE, INKJET PRINTHEAD, AND INKJET PRINTING APPARATUS

(75) Inventor: Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/861,677

(22) Filed: Aug. 23, 2010

(65) Prior Publication Data

US 2010/0315455 A1 Dec. 16, 2010

Related U.S. Application Data

(63) Continuation of application No. 12/145,415, filed on Jun. 24, 2008, now Pat. No. 7,806,496.

(30) Foreign Application Priority Data

Jun. 26, 2007 (JP) ..... 2007-167456

(51) Int. Cl.
*B41J 29/38* (2006.01)

(52) U.S. Cl. ..... 347/5; 347/9; 347/14

(58) Field of Classification Search ..... 347/5, 9, 347/10, 11, 12, 14, 15
See application file for complete search history.

(56) References Cited

U.S. PATENT DOCUMENTS 6,712,437 B2 * 3/2004 Furukawa et al. ..... 347/5

* cited by examiner

*Primary Examiner* — Lam S Nguyen
(74) *Attorney, Agent, or Firm* — Canon USA Inc IP Division

(57) ABSTRACT

A detector circuit for detecting a malfunction of a circuit due to a low third power supply voltage that has the same amplitude and potential as an input signal is provided. Based on an output signal of the detector circuit, whether an output of a second power supply voltage generation circuit for activating a heater driving circuit is allowed or not is determined. When the third power supply voltage is low and the heater driving circuit operates improperly, no power supply voltage is supplied from the second power supply voltage generation circuit. Since no power supply voltage is supplied to the heater driving circuit, the heater driving circuit does not drive a corresponding heater.

7 Claims, 11 Drawing Sheets

PRINTHEAD SUBSTRATE, INKJET PRINTHEAD, AND INKJET PRINTING APPARATUS

CROSS-REFERENCE TO RELATED APPLICATIONS

This application is a continuation of U.S. patent application Ser. No. 12/145,415 filed Jun. 24, 2008, which claims the benefit of Japanese Application No. 2007-167456 filed Jun. 26, 2007, all of which are hereby incorporated by reference herein in their entirety.

BACKGROUND OF THE INVENTION

1. Field of the Invention

The present invention relates to inkjet printheads and printing apparatuses using the same. More particularly, the present invention relates to an inkjet printhead substrate on which electrothermal transducers for generating heat energy necessary for ejecting ink and drive circuits for driving the electrothermal transducers are formed, a printhead, and a printing apparatus using the printhead.

2. Description of the Related Art

In general, electrothermal transducers (heaters) of a printhead mounted in an inkjet-based printing apparatus and drive circuits for driving the electrothermal transducers are formed on one and the same substrate using a semiconductor processing technique, as described in, for example, U.S. Pat. No. 6,290,334. One proposed example of such a printing apparatus has a printhead in which an ink supplying port is provided near the center of a substrate, and heaters are provided at positions facing each other with the ink supplying port provided therebetween.

FIG. 1 schematically illustrates circuit blocks and ink supplying ports of an inkjet printhead substrate (element substrate) 110 of this type.

Referring to FIG. 1, six ink supplying ports 111 are formed on the element substrate 110 formed of semiconductor. In order to simplify the drawing, a circuit block 115 including only one ink supplying port 111 at the left is illustrated, and circuit blocks 115 corresponding to the remaining five ink supplying slots 111 are only schematically illustrated. In the circuit block 115 corresponding to the ink supplying port 111 at the left, heaters 112 are arranged in an array at positions facing each other with the ink supplying port 111 provided therebetween. Drive circuits 113 for selecting and driving the corresponding heaters 112 are provided corresponding to the heaters 112. Pads 114 for applying power and signals to the heaters 112 and the drive circuits 113 are arranged at edges of the element substrate 110.

FIG. 2 schematically illustrates the circuit structure of one drive circuit 113 shown in FIG. 1 and the flow of a signal.

Data including image data applied to the pads 114 is connected to a shift register 204 and a decoder 205 included in an internal circuit via an input circuit 201. In this example shown in FIG. 2, the input data is applied as serial data, and the serial data is converted into parallel data by the shift register 204. The image data included in the converted parallel data is input via a latch (not shown) to a plurality of heater driving blocks 206 (eight heater driving blocks 206 are arranged in this example). The shift register 204 has the function of a block selecting circuit 203 for selecting the validity/invalidity of the heater driving blocks 206. Another portion of the converted parallel data is supplied to the decoder 205 disposed next to the shift register 204. The decoder 205 has the function of a time-division selecting circuit 202 for outputting a time-division selection signal for sequentially selecting heaters driven in the heater driving blocks 206.

FIG. 3 is a circuit diagram of the interior of one heater driving block.

A heater driving block 300 includes heater-driving metal-oxide semiconductor (MOS) transistors 305, level conversion circuits 304, and heater selecting circuits 305, which are arranged corresponding to heaters 306 arranged in an array. A heater power supply voltage (first power supply voltage) is applied from the outside to heater power supply lines 301. The heater-driving MOS transistors 305 perform the function of a switch for allowing or preventing the flow of current to the corresponding heaters 306. A block selection signal 302 and a time-division signal 303 are input to an AND gate serving as each of the heater selecting circuits 305. When these two signals become active, the output of the AND gate becomes active. The voltage amplitude of an output signal of the AND gate is converted by a corresponding one of the level conversion circuits 304 to a power supply voltage (second power supply voltage) that is higher than a drive voltage (third power supply voltage) at a level of a logic circuit including the input circuit and a corresponding one of the heater selecting circuits 305. The level-converted signal is applied to the gate of a corresponding one of the heater-driving MOS transistors 305. Current flows through the heater 306 connected to this heater-driving MOS transistor 305 in which the voltage has been applied to the gate thereof, thereby driving this corresponding heater 306.

The voltage amplitude of the output signal is converted to the higher second power supply voltage because of the following reason. By increasing the voltage applied to the gate of the heater-driving MOS transistor 305, the on-resistance of the heater-driving MOS transistor 305 is reduced. Accordingly, current can more efficiently flow through the heater 306.

If possible, the voltage value of the second power supply voltage should not exceed a circuit breakdown voltage and a gate breakdown voltage of the MOS, and the second power supply voltage should be set to as high a value as possible. Further, if possible, the voltage value of the second power supply voltage may be the same as the voltage value of the first power supply voltage, which is the voltage value of the heater power supply lines 301. In most cases, however, the power supply voltage applied to heaters is generally set to a relatively high value, such as 20 V or greater. In most cases, a complementary metal-oxide semiconductor (CMOS) inverter is generally processed to have a breakdown voltage of about 15 V. Since the gate breakdown voltage of a MOS depends on a gate oxide film, the gate breakdown voltage of the MOS must be sufficiently lower than the withstand voltage of the gate oxide film. It is therefore often difficult to match the optimal voltage of a voltage conversion circuit with a heater driving voltage. U.S. Pat. No. 6,971,735 describes an example in which a voltage input from the outside of a substrate is adjusted by making the thickness of a logic circuit on a printhead substrate thinner than the thickness of a heater driving section.

In this case, if a power supply line for supplying the second power supply voltage, which is different from the heater power supply voltage (first power supply voltage), is additionally provided, the cost of the overall system is increased.

In order to solve this problem, a power generation circuit for generating a desired second power supply voltage from a heater power supply voltage (first power supply voltage) is provided in the interior of a printhead substrate. An example of this type of circuit is described in Japanese Patent Laid-Open No. 11-129479. Furthermore, U.S. Pat. No. 6,712,437 describes an example of a circuit in which an input voltage VDD for a logic circuit is input to a heater-driving switching element. However, the description does not concern the relationship between a heater power supply voltage VH and a VDD circuit.

FIG. 9 illustrates an example of a power generation circuit.

The circuit shown in this example includes an nMOS transistor 803 and a resistor 804 constituting an nMOS source follower, and resistor dividers 801 and 802. The heater power supply voltage (first power supply voltage) is divided by the resistor dividers 801 and 802, and the divided voltage is applied to the gate of the nMOS transistor 803. An output of the source follower serves as the second power supply voltage. With the resistor dividers 801 and 802, the voltage applied to the gate of the nMOS transistor 803 can be set to a desired value. Accordingly, the second power supply voltage can be a voltage that is lower than the heater power supply voltage (first power supply voltage).

FIG. 5 is a circuit diagram of the internal structure of a level conversion circuit and its peripheral circuits. In FIG. 5, a heater-driving MOS transistor 505, a heater 506, a PMOS transistor 510, and an NMOS transistor 511 are shown.

A signal supplied from a heater selecting circuit is inverted by an inverter operating at the third power supply voltage to generate an inverted logic signal, and this generated signal is applied to the gate of an NMOS transistor and a PMOS transistor operating at the second power supply voltage. The transistors driven by the second power supply voltage need to be elements that can withstand the second power supply voltage.

As another circuit structure, a structure in which level conversion is performed immediately after an output of a shift register and a decoder is proposed.

FIG. 4 is a circuit block diagram of the structure in which level conversion is performed immediately after a shift register and a decoder.

Referring to FIG. 4, pads 401, a time-division selecting circuit 402, and a block selecting circuit 403 are shown. The point that is different from the foregoing circuit structure is that output signals of a shift register 404 and a decoder 405 are level-converted by level conversion circuits 411 and 412, respectively. Circuits driven by the third power supply voltage, which has the same voltage amplitude and the same potential as an input signal, are those enclosed by line 415. Circuit blocks driven by the second power supply voltage higher than the level-converted first power supply voltage are those enclosed by line 416. These circuit blocks enclosed by line 416 include heater driving blocks 406.

With this structure, it becomes unnecessary to dispose a level conversion circuit for each heater selecting circuit. Accordingly, the density of circuits near heaters become increased, and the layout area becomes reduced.

As has been described above, in circuits on an inkjet printhead semiconductor substrate, the third power supply voltage which has the voltage amplitude of an input signal and which activates logic circuit blocks is used. Further, the higher second power supply voltage applied to the gate of a MOS transistor, which is a switching element for controlling heater current, is used. The circuits are controlled and driven by these two power supply voltages. Further, an output signal of a drive circuit for supplying the third power supply voltage is converted by a level conversion circuit into a signal with the signal amplitude of the second power supply voltage.

The first and third power supply voltages are supplied from a printer body to the printhead semiconductor substrate. In most cases, the second power supply voltage is generated by converting the first power supply voltage via a power supply voltage generation circuit provided in the substrate to a voltage lower than the first power supply voltage.

The sequence of supplying these voltages to the printhead semiconductor substrate is such that, after the third power supply voltage is applied, the heater power supply voltage (first power supply voltage) is applied. This is because, if the heater power supply voltage (first power supply voltage) is applied in a state where no third power supply voltage is applied, the head may operate unexpectedly.

That is, in a state where the first power supply voltage is applied, the second power supply voltage is also applied inside the substrate. Therefore, the heater driving circuit including the level conversion circuit is enabled. In contrast, an input signal of the level conversion circuit is output from a circuit that operates based on the third power supply voltage. However, in a state where no third power supply voltage is applied, the logic thereof becomes indefinite. In this state, the logic of an output of the level conversion circuit becomes indefinite, which may result in the logic where an unexpected heater is turned on.

In order to avoid this indefinite logic state, it is necessary to supply the third power supply voltage and then the first power supply voltage, which is followed by generation of the second power supply voltage in the substrate. In order to apply the voltages in this sequence, special measures must be taken by the printer body, resulting in an increase in the cost.

SUMMARY OF THE INVENTION

The present invention provides a printhead substrate, an inkjet printhead, and an inkjet printing apparatus for preventing the flow of heater current due to an indefinite logic state even when a second power supply voltage and/or a heater power supply voltage (first power supply voltage) is applied prior to a third power supply voltage.

According to an aspect of the present invention, there is provided a printhead substrate including an electrothermal transducer configured to eject liquid and a drive circuit including a switching element configured to drive the electrothermal transducer. The drive circuit includes a logic circuit configured to control driving of the electrothermal transducer, and a power supply voltage generation circuit configured to generate, from a first power supply voltage applied to the electrothermal transducer, a second power supply voltage for activating the switching element based on a voltage value of a third power supply voltage for activating the logic circuit. In a case where the voltage value of the third power supply voltage is greater than or equal to a predetermined voltage value, the second power supply voltage for driving the switching element is generated from the first power supply voltage. In a case where the voltage value of the third power supply voltage is less than the predetermined voltage value, the switching element is not driven by the second power supply voltage.

Even when the supply of the third power supply voltage, which has the voltage amplitude of an input signal, is interrupted due to a certain reason, no abnormal current flows through heaters due to an indefinite logic state.

Further features of the present invention will become apparent from the following description of exemplary embodiments with reference to the attached drawings.

DESCRIPTION OF THE EMBODIMENTS

Exemplary embodiments of the present invention will now herein be described in detail with reference to the accompanying drawings.

The term "element substrate" used in the description does not refer to a simple substrate made of silicon semiconductor, but refers to a substrate on which elements and wiring lines are provided.

The expression "on the element substrate" does not simply refer to being on the surface of the element substrate, but also refers to being on the surface of the substrate and being inside the element substrate, near the surface thereof.

The term "print element" refers to, in the case of an inkjet print system, a structure including an ejection energy generating element for generating ejection energy for ejecting ink, an ejection port, and a channel.

First Exemplary Embodiment

Figure 6:
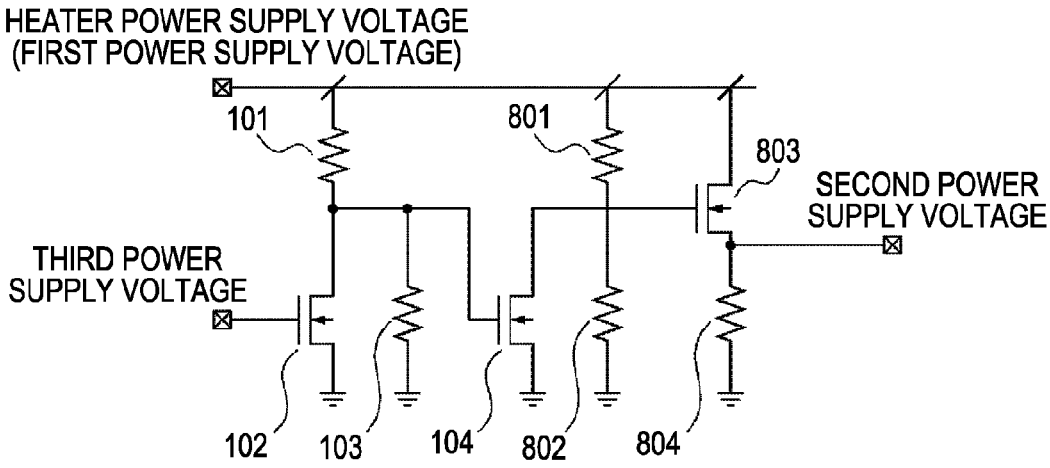
FIG. 6 is a circuit diagram of a second power supply voltage generation circuit for describing a first exemplary embodiment of the present invention.

FIG. 6 is a circuit diagram of, in a circuit structure inside an element substrate, a second power supply voltage generation circuit for describing a first exemplary embodiment of the present invention. The second power supply voltage generation circuit generates a second power supply voltage from a first power supply voltage serving as a heater power supply voltage.

Figure 13:
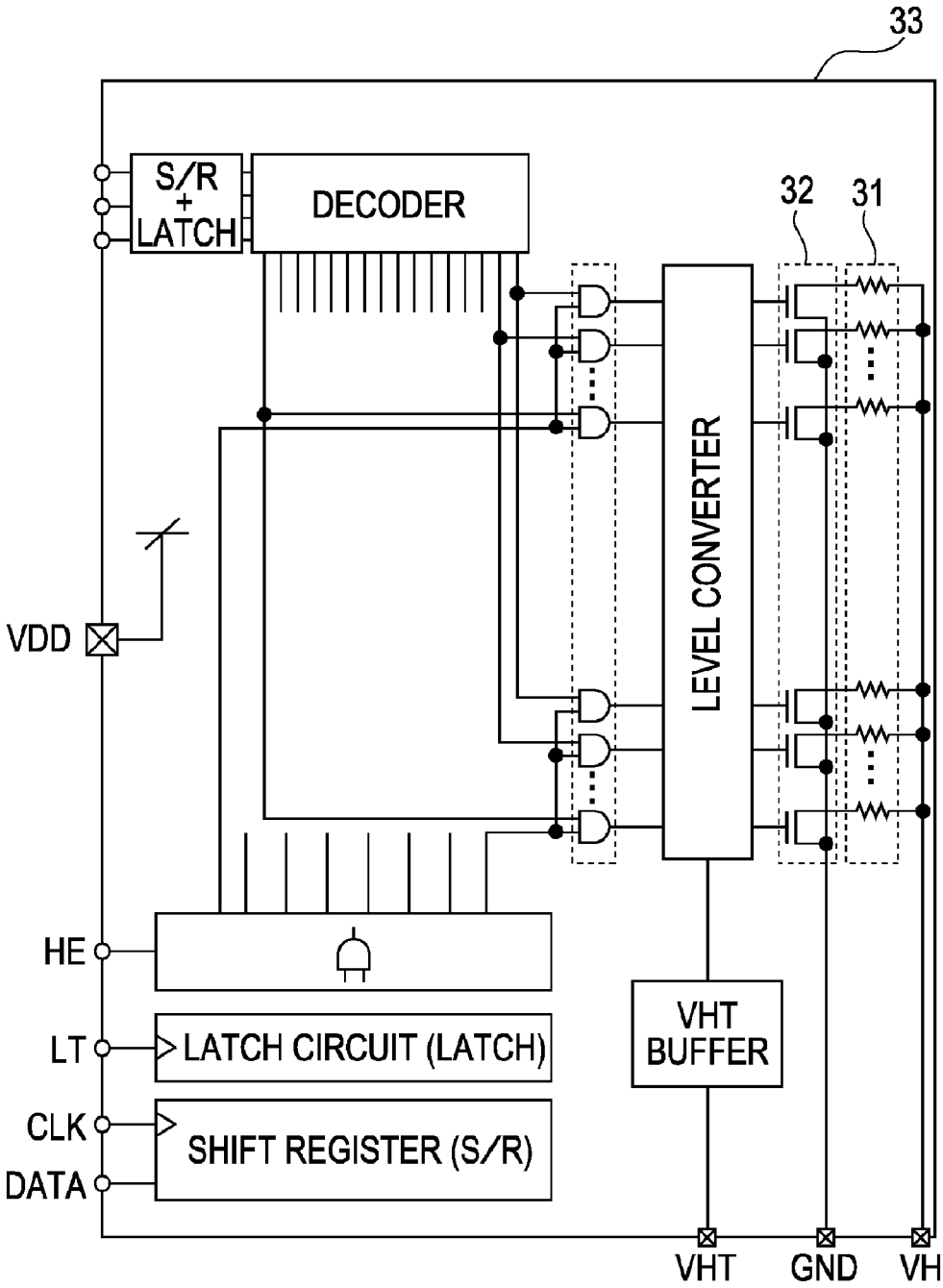
FIG. 13 schematically illustrates a printhead substrate according to an embodiment of the present invention.

FIG. 13 schematically illustrates a printhead substrate according to an embodiment of the present invention. A printhead substrate 33 includes a heater 31 serving as an electrothermal transducer, a VH which is a first power supply line for supplying power to the heater 31, a switching element 32 for driving the heater 31, and a logic circuit for controlling driving of the heater 31. The logic circuit is, as shown in FIG. 13, a circuit including a shift register and a latch circuit. In order to activate the logic circuit, a third power supply voltage VDD is input to the logic circuit. A second power supply voltage for activating the switching element 32 is a power supply voltage input to the switching element 32 shown in FIG. 13. The second power supply voltage may be, on the printhead substrate 33 shown in FIG. 13, a voltage output from a level converter and input to the switching element 32. Alternatively, the second power supply voltage may be provided through a power supply line VHT for driving the switching element 32 in FIG. 13.

Figure 9:
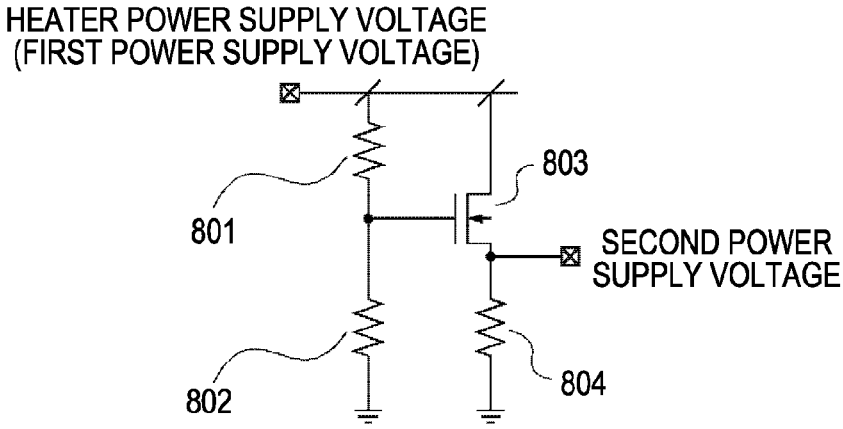
FIG. 9 is a circuit diagram of an example of a power generation circuit.

Referring back to FIG. 6, an nMOS transistor 803 and a resistor 804 constituting an nMOS source follower, and resistor dividers 801 and 802 are similar to those of a voltage generation circuit illustrated in the known example shown in FIG. 9. A resistor 101, an nMOS transistor 102, a resistor 103, and an nMOS transistor 104 constitute an additional circuit according to an embodiment of the present invention. With this additional circuit, turning on and off of a voltage supplying circuit is controlled.

The resistor 101 and the nMOS transistor 102 constitute a first inverter circuit operating at the heater power supply voltage. The third power supply voltage is applied to the gate of the nMOS transistor 102 serving as an input of the first inverter circuit. An output of the first inverter circuit is connected to the gate of the nMOS transistor 104.

The heater power supply voltage is a voltage applied to an electrothermal transducer (heater), as has been described above. In recent years, this voltage has been about 24 V. In the element substrate, this voltage is higher than other voltages.

Figure 1:
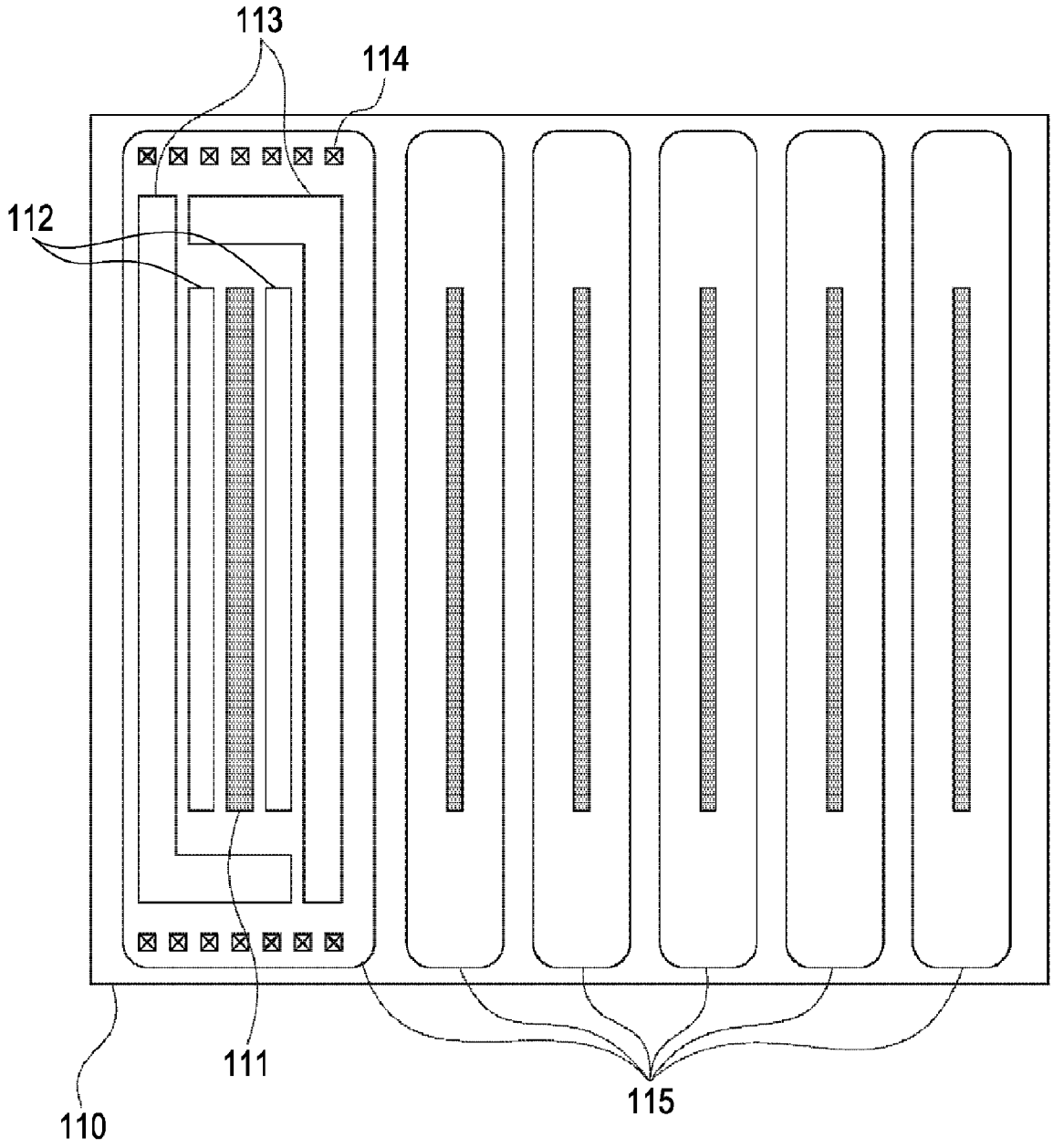
FIG. 1 PRIOR ART
FIG. 1 schematically illustrates circuit blocks and ink supplying ports provided on an inkjet printhead semiconductor substrate.
Figure 2:
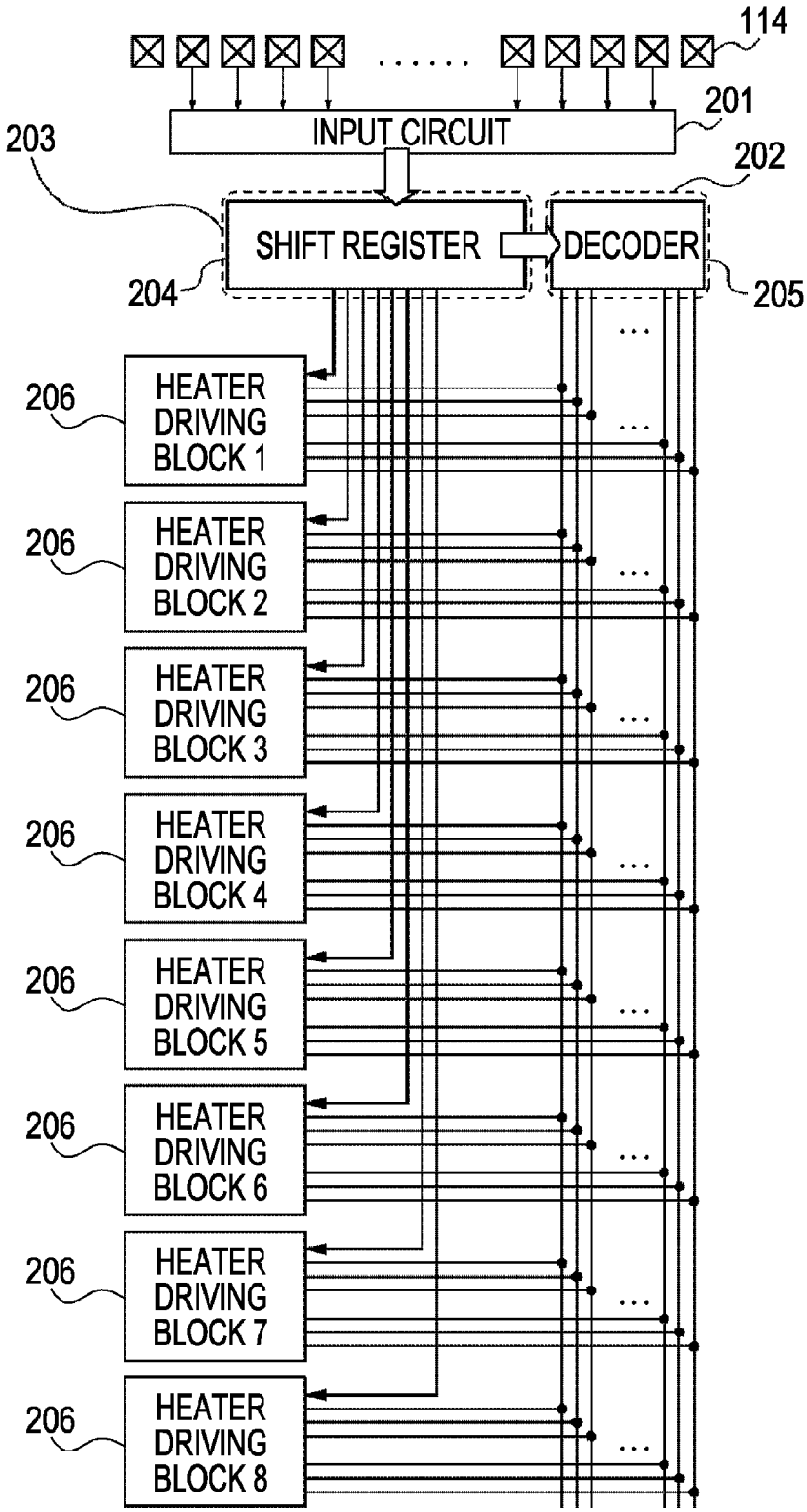
FIG. 2 PRIOR ART
FIG. 2 schematically illustrates the circuit structure of a drive circuit shown in FIG. 1 and the flow of a signal.

The third power supply voltage is a power supply voltage for driving the logic circuit including the shift register 204 and the decoder 205, which have been described using FIG. 2, for controlling driving of electrothermal transducers. A voltage of about 3.3 V is used as the third power supply voltage. A latch circuit may be provided at the subsequent stage of the shift register 204. The latch circuit is also driven by the third power supply voltage.

The resistor 103 is a resistor divider connected so that the voltage applied to the gate of a corresponding nMOS transistor does not exceed a gate breakdown voltage when the first inverter circuit is turned off. The resistor 103 must have a resistance value such that, when the nMOS transistor 102 is turned off, a divided voltage value obtained in conjunction with the resistor 101 is greater than or equal to a threshold voltage of the nMOS transistor 104 and less than the gate breakdown voltage of the nMOS transistor 104.

The resistor 103 is unnecessary when the gate breakdown voltage of the nMOS transistor 104 is greater than or equal to the heater power supply voltage.

The nMOS transistor 104 constitutes, together with the resistor divider 801 of the voltage supplying circuit, a second inverter circuit. That is, the resistor divider 801 plays both the function of the resistor divider of the voltage supplying circuit and the function in the second inverter circuit.

An output of the second inverter circuit is connected to the gate of the nMOS transistor 803 constituting the nMOS source follower circuit.

The operation of a power supply voltage generation circuit according to the present embodiment is described below.

When the third power supply voltage greater than or equal to a threshold voltage of the nMOS transistor 102 is applied, the output of the first inverter circuit is substantially 0 V. Therefore, the nMOS transistor 104 included in the second inverter circuit is turned off, and the power supply voltage generation circuit is in an operating state similar to that of the circuit of the known example.

In contrast, when the third power supply voltage is less than the threshold voltage of the nMOS transistor 102, the output of the first inverter circuit is a divided voltage value obtained by the resistor 101 and the resistor 103. Since a voltage obtained from the divided voltage obtained by the resistor 101 and the resistor 103 is set to be greater than or equal to the threshold of the nMOS transistor 104, the nMOS transistor 104 is turned on. In this state, the gate voltage of the nMOS transistor 803, which is the output of the second inverter circuit, is substantially 0 V, and the nMOS transistor 803 is turned off. Since the nMOS transistor 803 is turned off, the output of the second power supply voltage is fixed to 0 V.

Figure 3:
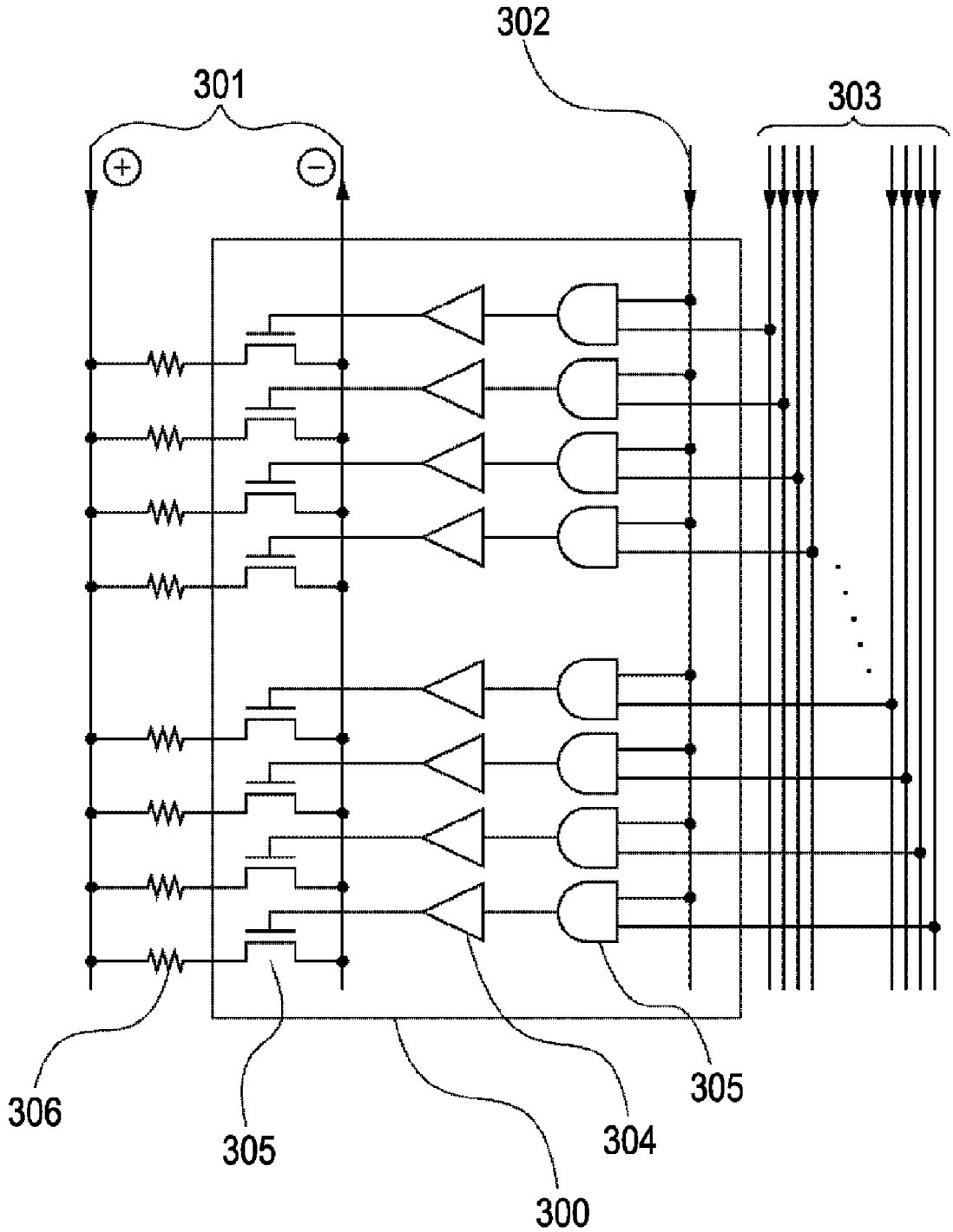
FIG. 3 PRIOR ART
FIG. 3 is a circuit diagram of the interior of a heater driving block in a known example.
Figure 4:
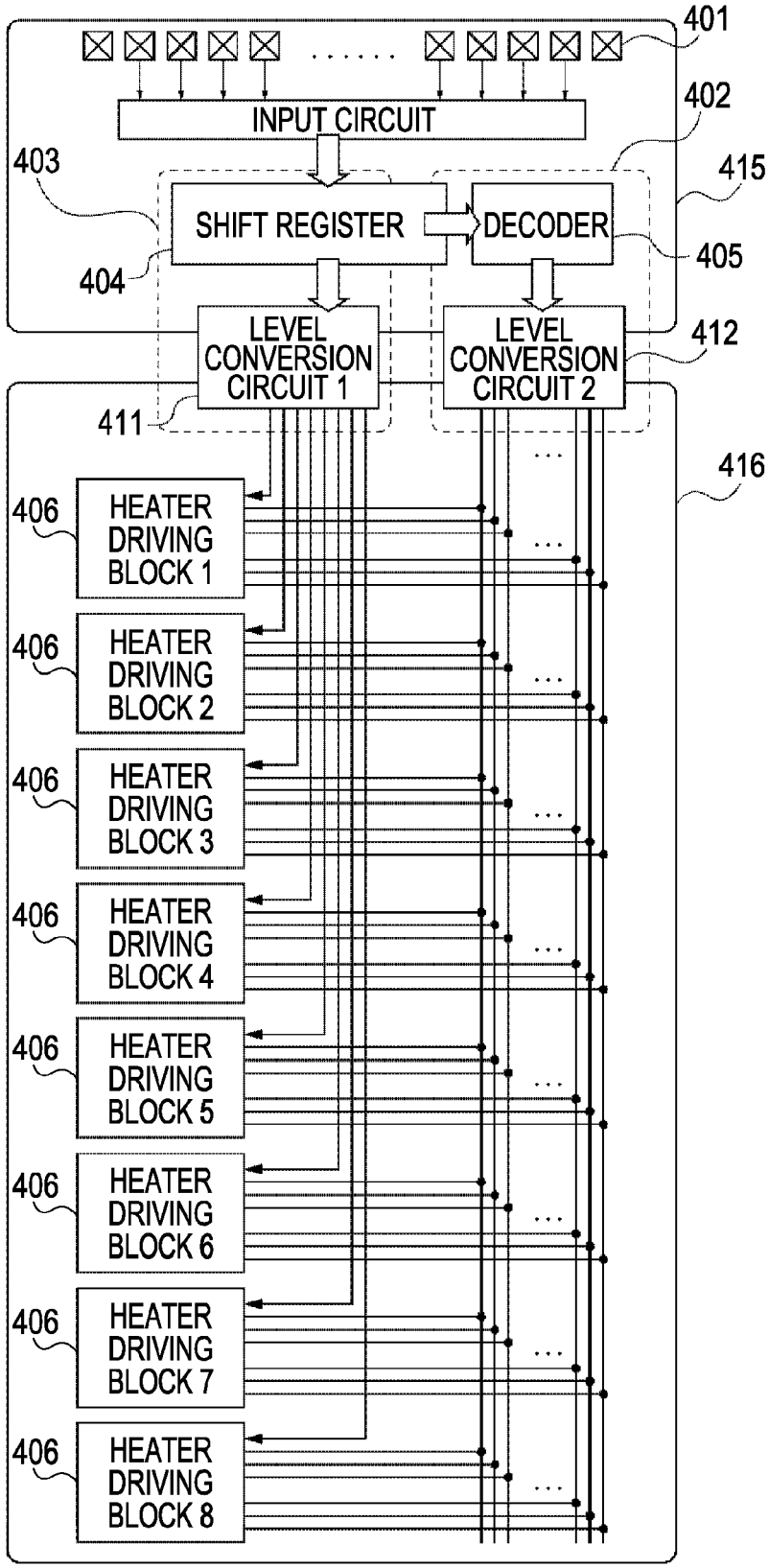
FIG. 4 PRIOR ART
FIG. 4 is a circuit block diagram of the structure in which level conversion is performed immediately after a shift register and a decoder in a known example.
Figure 5:
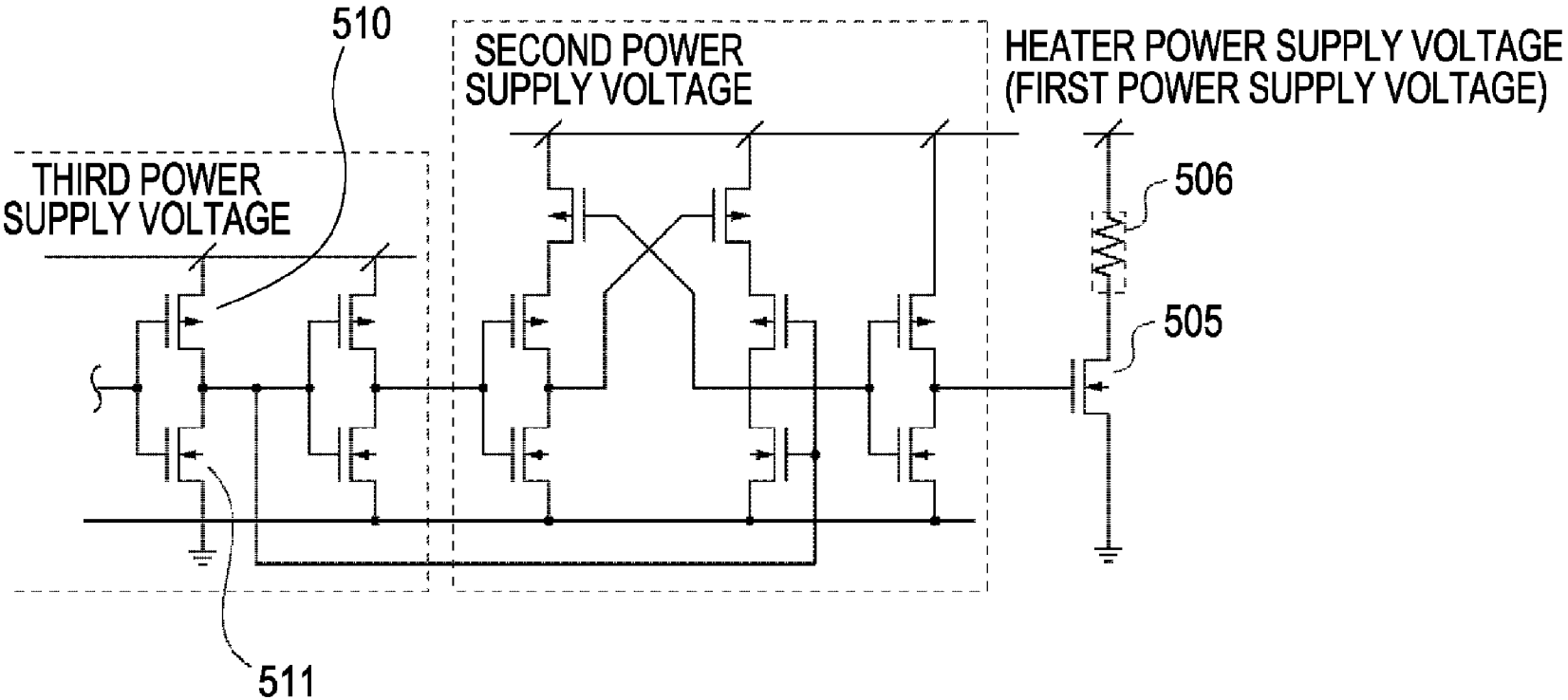
FIG. 5 is a circuit diagram of the internal structure of a level conversion circuit and its peripheral circuits.
Figure 12:
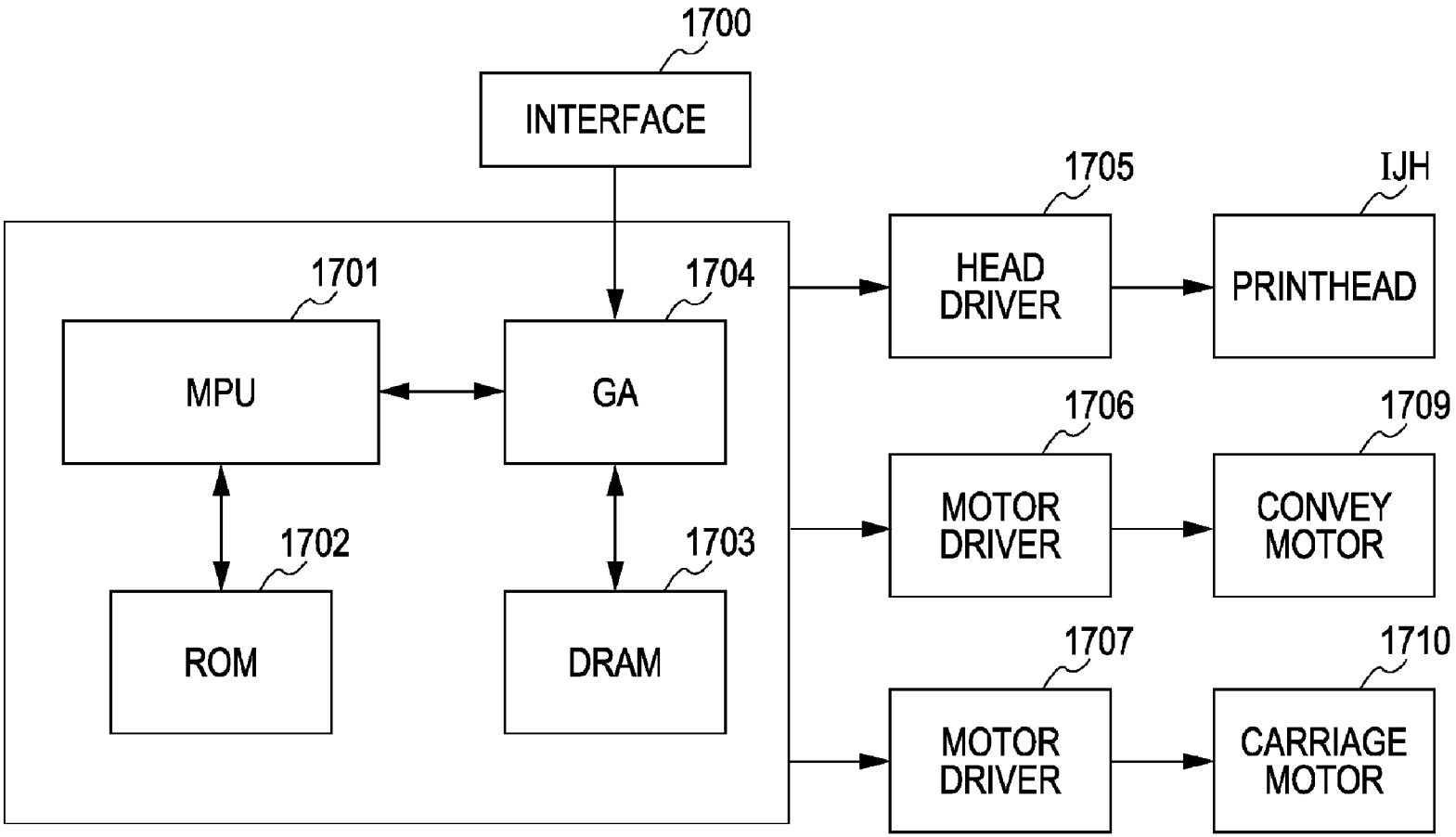
FIG. 12 is a block diagram of a control structure of the printing apparatus.

The second power supply voltage is a voltage applied to a heater-driving MOS transistor (switching element), which is a switch for allowing or preventing the flow of current to a corresponding electrothermal transducer (see FIGS. 3, 5, and 12).

That is, when the third power supply voltage is properly applied, the second power supply voltage is supplied. In contrast, when the third power supply voltage is not properly applied, the second power supply voltage is not supplied, resulting in 0 V.

When the second power supply voltage is 0 V, the output of the heater driving circuit becomes 0 V. That is, when the second power supply voltage is 0 V, no abnormal current is allowed to flow through the heater due to an indefinite logic state.

Whether the second power supply voltage is output or not depends on whether the third power supply voltage is greater than or equal to or less than the threshold voltage of the nMOS transistor 102. If the nMOS transistor 102 has the same structure as an nMOS transistor which is included in the level conversion circuit shown in FIG. 5 and which is driven by the second power supply voltage, the threshold of the power supplying circuit can be substantially equivalent to the threshold of the level conversion circuit. Accordingly, an indefinite logic state due to application of the third power supply voltage less than the threshold of the level conversion circuit can be avoided.

Second Exemplary Embodiment

Figure 7:
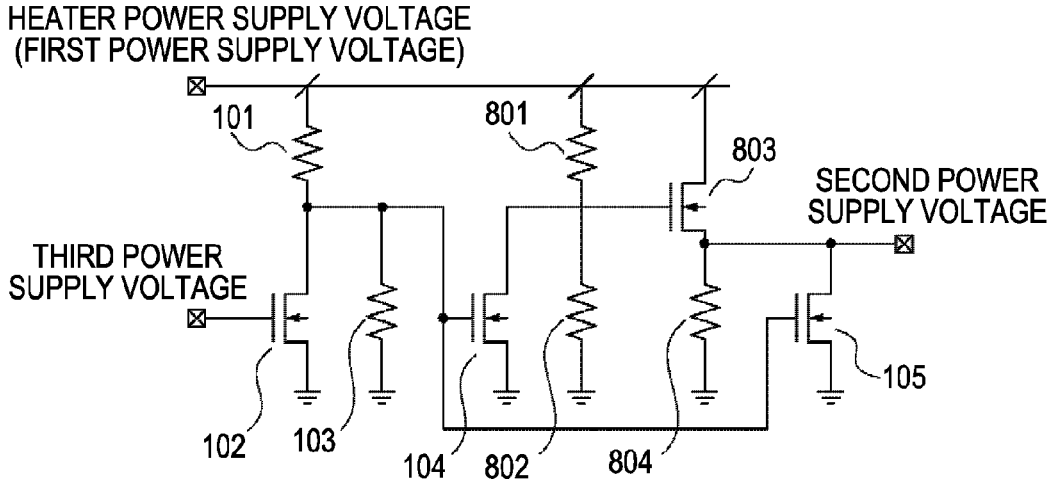
FIG. 7 is a circuit diagram of a second power supply voltage generation circuit for describing a second exemplary embodiment of the present invention.

FIG. 7 is a circuit diagram of a second power supply voltage generation circuit for describing a second exemplary embodiment of the present invention. In contrast to the second power supply voltage generation circuit of the first exemplary embodiment, the second power supply voltage generation circuit according to the second exemplary embodiment has a feature that an nMOS transistor 105 is added to a second power supply voltage node.

In order that the nMOS transistor 105 is turned off when the output of the second power supply voltage is valid and turned on when the output of the second power supply voltage is invalid, the nMOS transistor 105 is connected so that the gate of the nMOS transistor 105 is parallel to the gate of the nMOS transistor 104.

The nMOS transistor 105 is disposed in order to function as a current path for causing the second power supply voltage to quickly converge to 0 V when the second power supply voltage generation circuit which has been turned on is turned off.

Many circuits constituting level conversion circuits and the like are connected to the second power supply voltage. Elements constituting these circuits have capacitive components. These capacitive components accumulate electric charge when the output of the second power supply voltage is valid. Now, suppose that the supply of the third power supply voltage which has been properly applied is unexpectedly stopped due to a certain reason.

When there is no nMOS transistor 105, the source follower nMOS transistor 803 is turned off. No electric charge is supplied to the second power supply voltage. Electric charge in the second power supply voltage line is discharged to ground GND via the resistor 804.

The resistor 804 is a resistor included in the nMOS source follower circuit. In most cases, the resistor 804 is set to a high resistance value of about a few tens of kΩ to a few hundreds of kΩ. When many elements are connected to the second power supply voltage and the capacitance of the second power supply line is large, a time constant based on the capacitance and the resistor 804 becomes large. When the power supplying circuit which has been turned on is now turned off, regardless of the fact that the third power supply voltage has a value based on which the logic cannot be determined, due to the remaining electric charge in the second power supply voltage line, the circuits which are connected to the second power supply voltage and which remain in the indefinite logic state may start operating.

The present embodiment provides a structure for avoiding maintaining such a transient indefinite logic state.

The nMOS transistor 105 is disposed so as to bypass the source follower resistor 804. Accordingly, when the power supplying circuit which has been turned on is now turned off, the remaining electric charge in the second power supply voltage line can be quickly discharged, and the supply of the second power supply voltage to circuits that operate based on the second power supply voltage can be cut off.

When the third power supply voltage decreases and becomes less than the threshold voltage of the nMOS transistor 102, the output of the first inverter circuit becomes a divided voltage value obtained by the resistor 101 and the resistor 103. In this case, a voltage obtained from the divided voltage obtained by the resistor 101 and the resistor 103 is set to be greater than or equal to a threshold of the nMOS transistor 105. Accordingly, the nMOS transistor 104 is turned on. In this state, the gate voltage of the nMOS transistor 803, which is the output of the second inverter circuit, is substantially 0 V, and the nMOS transistor 803 is turned off. Since the nMOS transistor 105 is turned on, the electric charge accumulated in the second power supply voltage line is discharged to ground GND, and the second power supply voltage quickly converges to 0 V.

Since the power supply voltage of the circuits operating based on the second power supply voltage quickly converges to 0 V and the output of the heater driving circuit becomes 0 V, no abnormal current is permitted to flow through the heater for a long time due to an indefinite logic state.

In the foregoing embodiment, the description assumes that the first power supply voltage is applied from the outside to the printhead substrate. However, for the third power supply voltage, a power generation circuit may be provided on the printhead substrate, and the power generation circuit may generate the third power supply voltage from the heater power supply voltage and supply the generated third power supply voltage to the interior of the substrate.

Since the third power supply voltage generation circuit is provided inside the substrate, it becomes unnecessary to supply power supply voltages from a printer body to the substrate. Accordingly, the number of connection terminals can be reduced, and a power supply circuit of the printer body can be further simplified. In this case, the flow of abnormal current due to an indefinite logic state can be avoided by causing the output of the second power supply voltage generation circuit to become valid after the output voltage (third power supply voltage) of the third power supply voltage generation circuit in the printhead substrate becomes stable.

In the foregoing embodiment, whether to turn on and off the supply of the second power supply voltage is determined by the value of the third power supply voltage. Alternatively, this determination can be made by a signal indicating the state of the head or the printer body. Alternatively, power or a signal for making the determination may be applied as current.

Figure 8:
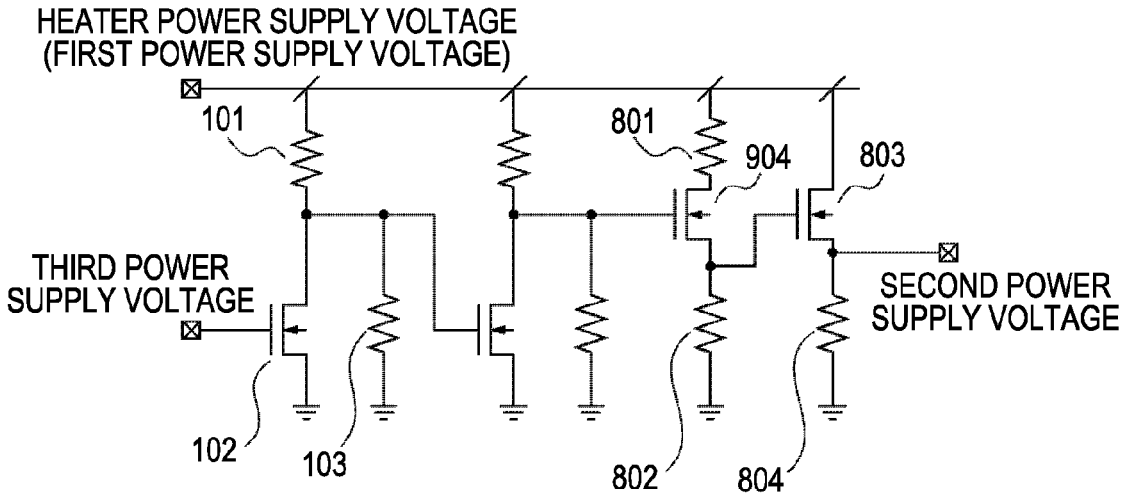
FIG. 8 is a circuit diagram of a second power supply voltage generation circuit for describing another example of the circuit structure according to an embodiment of the present invention.

Although turning on and off the output of the power supply voltage generation circuit is controlled depending on whether the gate of the output nMOS transistor 803 is pulled down to GND potential or not in the first and second exemplary embodiments, the description is not intended to limit the circuit structure. For example, referring to FIG. 8, an nMOS transistor 904 may be connected in series between the resistors 801 and 802, and a node between the nMOS transistor 904 and the resistor 802 may be connected to the gate of the nMOS transistor 803. In the structure shown in FIG. 8, when the output is valid, the nMOS transistor 904 is turned on, and a divided voltage obtained from the sum voltage of the resistor 801 and the nMOS transistor 904 and the voltage of the resistor 802 is applied to the gate of the nMOS transistor 803, thereby outputting the second power supply voltage. In contrast, when the output is invalid, the gate voltage of the nMOS transistor 904 becomes GND potential, and the nMOS transistor 904 is turned off. Accordingly, the gate voltage of the nMOS transistor 804 becomes GND potential, and the second power supply voltage becomes 0 V.

The present invention can be achieved using various circuit structures other than those described above. A common feature of the circuit structures is that the output of the second power supply voltage generation circuit is controlled according to the state of the third power supply voltage. That is, turning on (valid) and off (invalid) the output of the second power supply voltage generation circuit is controlled according to whether the output of circuits operating at the third power supply voltage can control the level conversion circuit operating at the second power supply voltage.

When the level conversion circuit is determined uncontrollable, the output of the second power supply voltage generation circuit is fixed to 0 V. Accordingly, no unexpected heaters are selected and driven.

Other Exemplary Embodiments

Figure 10:
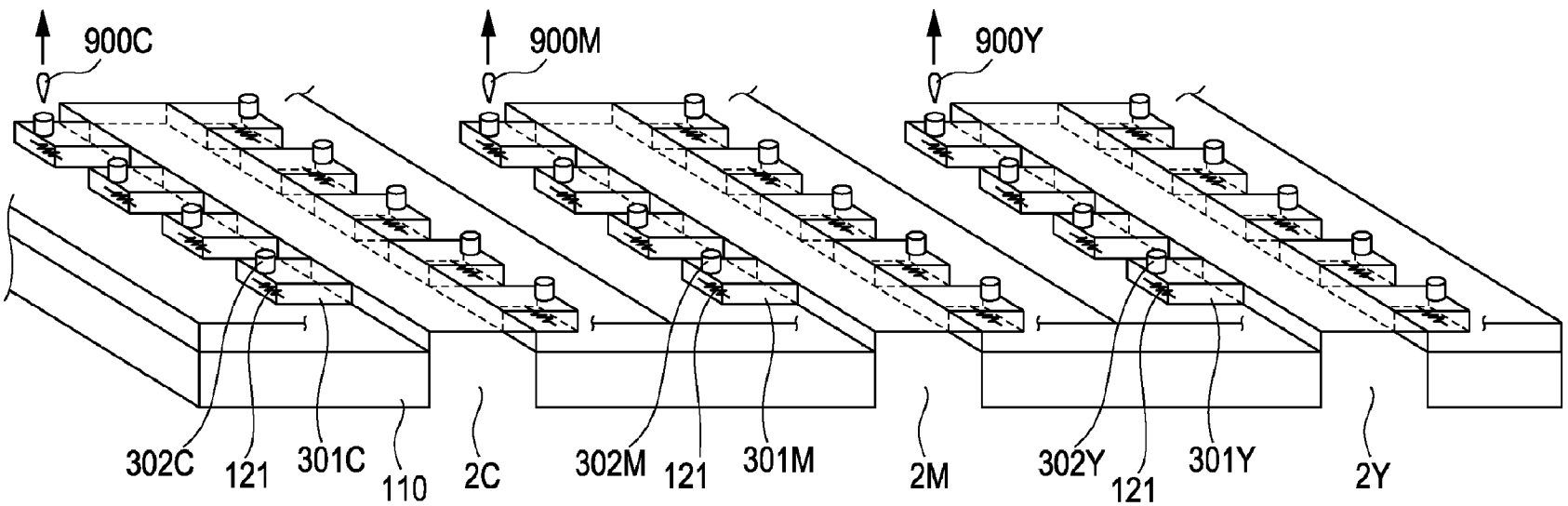
FIG. 10 is a perspective view of a three-dimensional structure of a printhead IJHC for ejecting three colors of color ink.

Referring now to FIG. 10, the schematic structure of a printhead according to an embodiment of the present invention is described. FIG. 10 is a perspective view of a three-dimensional structure of a printhead for ejecting three colors of color ink.

The printhead includes ink supplying ports 2C, 2M, and 2Y for supplying cyan (C), magenta (M), and yellow (Y) ink, respectively.

Ink channels 301C, 301M, and 301Y are provided corresponding to electrothermal transducers (heaters) 121. C ink, M ink, and Y ink are directed via these ink channels 301C, 301M, and 301Y to the electrothermal transducers (heaters) 121 provided on an element substrate 110. When the electrothermal transducers (heaters) 121 are driven, the ink boils, and bubbles are generated. With the generated bubbles, ink droplets 900C, 900M, and 900Y are ejected through ejection ports 302C, 302M, and 302Y provided for the corresponding electrothermal transducers (heaters) 121.

With continued reference to FIG. 10, the electrothermal transducers (heaters) 121, drive circuits, and pads, which have been described above, are formed on the element substrate 110.

Although the three-dimensional structure of the color-type printhead IJHC having three ink supplying ports is illustrated in FIG. 10, a printhead IJHK for ejecting black ink has a similar structure. The structure of the printhead IJHK for ejecting black ink is one-third of the structure shown in FIG. 10. That is, the structure has only one ink supplying port. When the number of print elements to be arranged is the same, the size of an element substrate of the printhead IJHK is about one-third the size of the element substrate 110 shown in FIG. 10.

The schematic structure of a printing apparatus for performing printing using such a printhead is described.

Description of Inkjet Printing Apparatus

Figure 11:
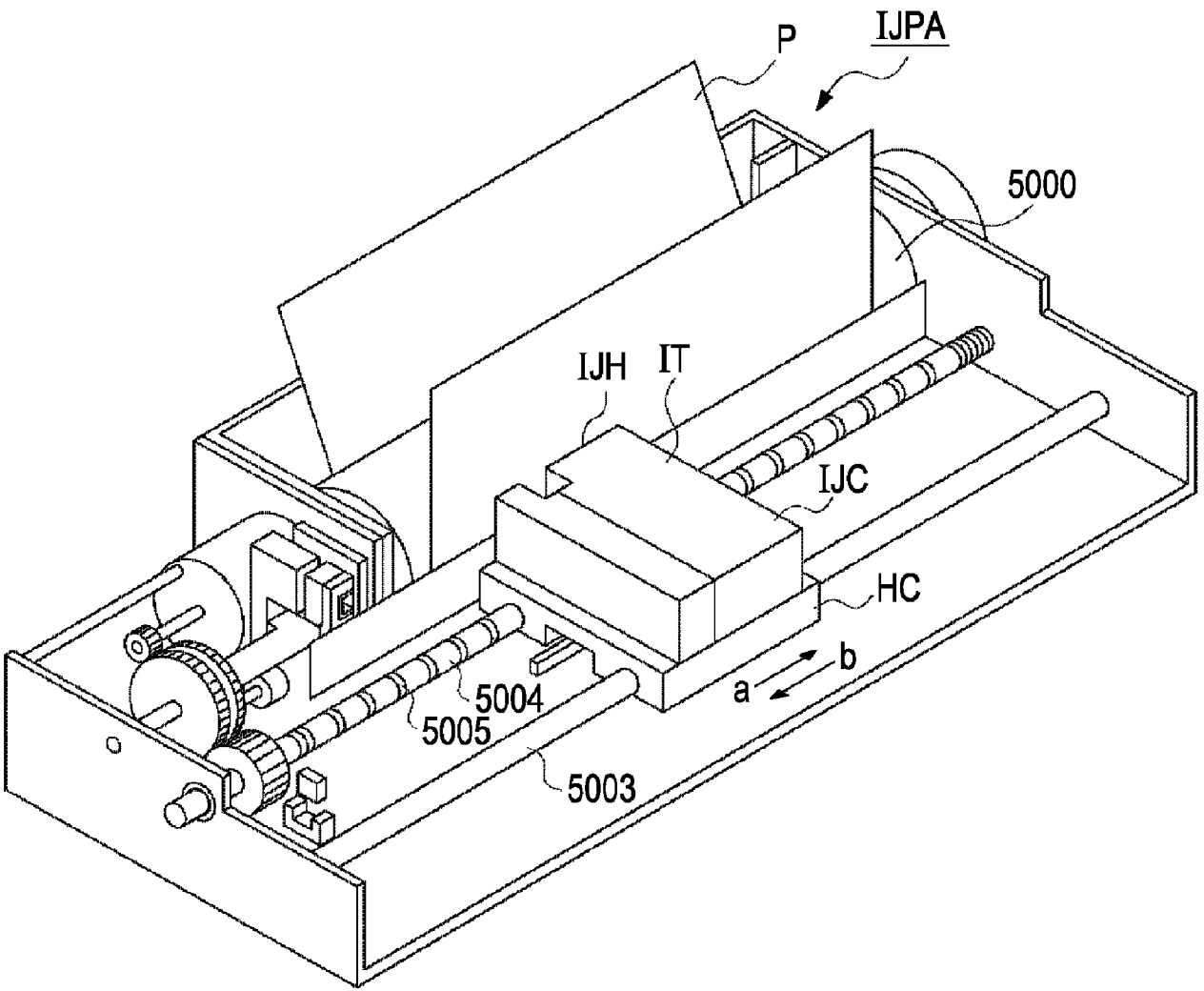
FIG. 11 is an external view of a printing apparatus applicable to an embodiment of the present invention.

FIG. 11 is an external view of a typical inkjet printing apparatus IJPA according to an embodiment of the present invention. A carriage HC has a pin (not shown) that engages with a spiral groove 5005 of a lead screw 5004. The carriage HC, which is supported by a guide rail 5003, reciprocates in the directions a and b indicated by arrows in accordance with the rotation of the lead screw 5004. The carriage HC has an inkjet cartridge IJC. The inkjet cartridge IJC has an inkjet printhead IJH (hereinafter referred to as a "printhead") and an ink tank IT for storing print ink.

The inkjet cartridge IJC includes the printhead IJH and the ink tank IT, which are integrated with each other. A platen 5000 is rotated by a convey motor (not shown) and conveys print paper P.

FIG. 12 is a block diagram of a control structure of the printing apparatus. Referring to FIG. 12, the control structure includes an interface 1700 for receiving a print signal, a microprocessing unit (MPU) 1701, a read-only memory (ROM) 1702 for storing a control program executed by the MPU 1701, a dynamic random access memory (DRAM) 1703 for storing various items of data (print data supplied to the foregoing printhead IJH, or the like), and a gate array (GA) 1704 for controlling the supply of print data to the printhead IJH. The GA 1704 controls data transfer among the interface 1700, the MPU 1701, and the RAM 1703.

Further, the control structure includes a convey motor 1709 (which has not been shown in FIG. 11) for conveying print paper P, a motor driver 1706 for driving the convey motor 1709, a motor driver 1707 for driving a carriage motor 1710, and a head driver (driver circuit) 1705 for driving the printhead IJH. The head driver 1705 outputs data including image data, time-division data, and identification data and the above-described first and third power supply voltages to the printhead IJH.

The operation of the foregoing control structure is described. When a print signal is input to the interface 1700, the print signal is converted into print data through the GA 1704 and the MPU 1701. Thereafter, the motor drivers 1706 and 1707 are driven, and the printhead IJH is driven in accordance with the print data sent to the carriage HC, thereby printing an image on the print paper P.

In the foregoing embodiments, the inkjet printhead using the electrothermal transducers (heaters) as ejection energy generating elements constituting print elements has been described by way of example. However, the present invention is also applicable to an inkjet printhead using piezoelectric elements as ejection energy generating elements or a thermal head that can be used in a dye sublimation type or the like.

In the case of the inkjet printhead having the foregoing ink supplying ports, because the circuit structure is segmented by the ink supplying ports, drive circuits for heaters arranged in an array must be provided on a row-by-row basis. Accordingly, it is greatly advantageous to apply the structure according to the foregoing embodiments of the present invention to the inkjet printhead.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

What is claimed is:

1. An inkjet printhead substrate to which a first power supply voltage to be used for conducting current to an electrothermal transducer generating heat energy for discharging liquid, and a third power supply voltage to be used for operating a logic circuit for generating a driving signal for driving the electrothermal transducer are applied from outside, the inkjet printhead substrate comprising:

the electrothermal transducer;

the logic circuit;

a switching element configured to control whether to conduct current to the electrothermal transducer, based on the driving signal;

a converting circuit configured to amplify a first amplitude of a driving signal output from the logic circuit to a second amplitude necessary for an operation of the switching element; and a power supply voltage generating circuit configured to generate a second power supply voltage to be used for amplifying the first amplitude to the second amplitude from the first power supply voltage, only at a timing when the third power supply voltage is applied, wherein the power supply voltage generating circuit includes a ground circuit causing an output voltage to converge to a GND potential when applying of the third power supply voltage is stopped.

2. The inkjet printhead according to claim 1, wherein the ground circuit includes an nMOS transistor for grounding.

3. The inkjet printhead according to claim 1, wherein the power supply voltage generating circuit includes a source follower nMOS transistor to be used as a source follower circuit.

4. The inkjet printhead according to claim 3, wherein a voltage is applied to a gate terminal of the source follower nMOS transistor only at a timing when the third power supply voltage is being applied.

5. The inkjet printhead according to claim 1, wherein a voltage value of the second power supply voltage is lower than a voltage value of the first power supply voltage, and a voltage value of the third power supply voltage is lower than the voltage values of the first and the second power supply voltages.

6. An inkjet printhead comprising:

the inkjet printhead substrate according to claim 1; and an ejection port provided corresponding to the electrothermal transducer.

7. An inkjet printing apparatus comprising:

the inkjet printhead according to claim 6; and an output circuit configured to output the first power supply voltage and the third power supply voltage to the inkjet printhead.

* * * * *